United States Patent [19]

Katagi

[11] 3,967,038

[45] June 29, 1976

[54] UNTWISTED SYNTHETIC RESIN STRING AND APPARATUS FOR MANUFACTURING THE STRING

[75] Inventor: Fusao Katagi, Sakai, Japan

[73] Assignee: Katagi Goseikagaku Kabushiki Kaisha, Sakai, Japan

[22] Filed: Oct. 22, 1974

[21] Appl. No.: 516,958

[52] U.S. Cl. ..... 428/397; 428/126; 428/364; 428/377

[51] Int. Cl.[2] ..... B32B 3/04; D02G 3/00

[58] Field of Search ..... 161/172, 177, 180, 103, 161/104; 428/364, 397, 375, 377, 121, 124, 126, 129

[56] References Cited

UNITED STATES PATENTS

| | | | |
|---|---|---|---|
| 1,497,189 | 6/1924 | Mitchell | 161/104 X |
| 2,219,115 | 10/1940 | Sackner et al. | 161/177 X |
| 2,633,893 | 4/1953 | Philippi | 161/177 X |
| 3,415,710 | 10/1968 | Arnold | 428/126 X |
| 3,416,991 | 12/1968 | Yoshimura | 161/104 X |
| 3,655,500 | 4/1972 | Johnson | 161/104 |

*Primary Examiner*—Lorraine T. Kendell

*Attorney, Agent, or Firm*—Armstrong, Nikaido & Wegner

[57] ABSTRACT

Untwisted synthetic resin string comprising two rolled portions each spiral in cross section and formed by inwardly rolling toward each other the opposite side edges of a strip of thermoplastic resin film stretched at least longitudinally thereof. The rolled portions extend longitudinally of the string in parallel with each other and are partially adhered together longitudinally thereof. Also disclosed are an apparatus for manufacturing the untwisted string from a strip of thermoplastic resin stretched at least longitudinally thereof and another apparatus for manufacturing an untwisted string having a single rolled portion from like resin strip.

3 Claims, 10 Drawing Figures

UNTWISTED SYNTHETIC RESIN STRING AND APPARATUS FOR MANUFACTURING THE STRING

BACKGROUND OF THE INVENTION

Synthetic resin strings are extensively used for automatic packaging or binding machines, agricultural binders, hay balers and the like as well as for handicraft knitted articles.

The strings of this type are divided into twisted strings and untwisted strings.

Twisted strings are produced by mechanically twisting a stretched synthetic resin film or a split yarn or yarns obtained by longitudinally slitting a stretched synthetic resin film. However, the twisting operation is very inefficient and costly, entailing a low overall productivity and high manufacturing cost. The product itself, being twisted, has continuous protuberances, which tend to impede smooth movement of the string when it is paid out from a binder, producing a failure in binding operation. Moreover, the twist given to the string imparts stiffness to the string and impairs its shock-absorbing properties, with the result that the knot of binding string is liable to loosen.

Since the strings of the latter type are not twisted, they can be manufactured more efficiently and inexpensively than twisted strings, have improved smoothness and shock-absorbing properties and are lightweight and flexible, but if a stretched thermoplastic resin film is made into a thin string merely by being passed through a bundling ring or the like without twisting, the string will loosen and unfold to the original planar film, failing to retain shock-absorbing properties and bulkiness. Moreover, the string will then be prone to tearing. These objections make the string no longer serviceable for a binder. To eliminate such deficiencies, it has been practiced to cover the string with a film tube or to heat-set the string so as to prevent loosening and unfolding of the string. However when covered with the tube, the resulting double construction deteriorates the advantages of untwisted string described and entails reduced productivity and increased manufacturing cost, whilst the heat-setting treatment, unless conducted ingeniously, produces variations in the diametrical size of untwisted string. When subjected to excess heat-setting treatment, the string which is made of thermoplastic synthetic resin is hardened to exhibit poor flexibility, and when hardened up to its interior, the string fails to retain satisfactory shock-absorbing properties.

SUMMARY OF THE INVENTION

An object of this invention is to overcome the foregoing drawbacks and to provide an untwisted string comprising two portions which are rolled up in opposite directions to each other unlike conventional untwisted strings and rectilinearly longitudinally adhered together on their outer peripheral portions, each of the rolled portions being loose in its interior, such that the string is prevented from loosening and unfolding and is free of fluffiness and excellent in shock-absorbing properties, impact resistance, uniformity and tensile strength.

Another object of this invention is to provide apparatus for efficiently manufacturing untwisted strings which are lightweight, flexible, free of fluffiness and excellent in shock-absorbing properties, bulkiness, hand, uniformity, tensile strength and binding ability.

The problems described can be overcome by an apparatus comprising stretching means for stretching a strip of thermoplastic resin film at least longitudinally thereof, roll-forming means disposed to the rear of the stretching means and including a plurality of rolling members whose radius of curvature is reduced from member to member toward the direction of advance of the stretched film strip to roll up the opposite side edges of the film strip in opposite directions to each other, and heat-setting means disposed to the rear of the roll-forming means for thermally adhering the two portions rolled up by the roll-forming means. When passing over the first of the rolling members, the opposite side edges of the stretched film strip are inwardly rolled toward each other in opposite directions in conformity with the radius of curvature of the first rolling member and are thereafter rolled inward with the subsequent rolling members whose radius of curvature is reduced progressively. When the rolled film strip has finally passed over the terminal rolling member, the two oppositely rolled portions come into intimate contact with each other and are adhered together by the heat-setting means.

These and other objects, features and advantages of this invention will become apparent from the following description given with reference to the accompanying drawings showing embodiments of this invention for illustrative purposes only.

DETAILED DESCRIPTION OF THE INVENTION

Figure 1:
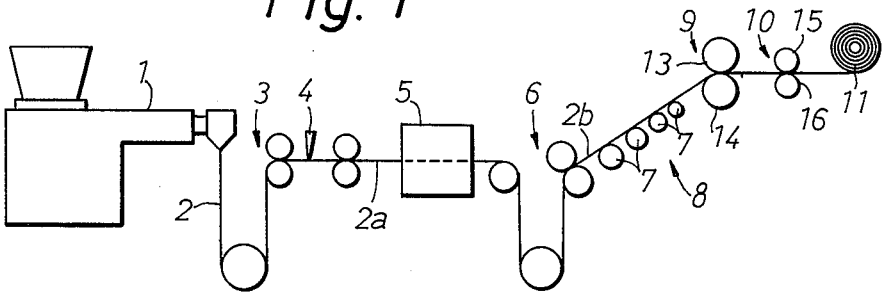
FIG. 1 is a schematic diagram showing a basic embodiment of the apparatus of this invention.

With reference to FIG. 1, an embodiment of the apparatus of this invention will be described. Indicated at 1 is a melt extruder for T-die process or inflation process. Polyethylene, polypropylene or like thermoplastic resin is extruded in the form of a strip by extruder of the former type or in the form of a tube by extruder of the latter type. The film 2 thus extruded is cooled by cooling means 3 comprising a group of cooling rolls or the like and is then cut by a slitter 4 onto narrow film strips 2*a*, which are introduced into heating means 5 such as an oven and heated to a temperature suitable for stretching. Each of the narrow film strips 2*a* is thereafter stretched and oriented by stretching means 6 at least in a longitudinal direction by stretching means 6 comprising a group of rolls.

Disposed to the rear of the stretching means 6 is roll-forming means 8 comprising a number of rolling members 7. Positioned behind the roll-forming means 8 are bundling means 9 and heat-setting means 10 which are arranged in such order. To the rear of the heat-setting means 10 there is takeup means 11.

Figure 2:
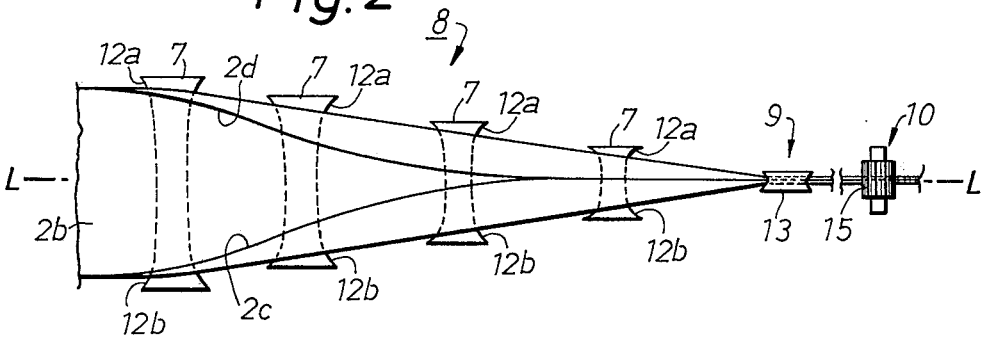
FIG. 2 is an enlarged plan view showing the principal part of the same.
Figure 3:
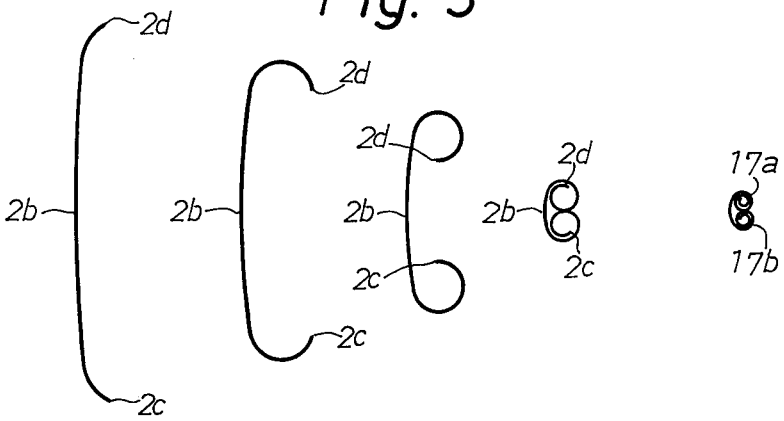
FIG. 3 is a view illustrating the steps of rolling a film strip.

FIGS. 2 and 3 show details of the roll-forming means 8 disposed behind the stretching means 6. Each of a multiplicity of rolling members 7 is in the form of a pulley-like roll having curved rolling surfaces at its opposite ends. The length of a first rolling member 7 is at least greater than the width of stretched film strip 2*b*. The rolling members 7 are disposed transversely of the centerline L—L of travel of the film strip 2*b* at right angles therewith and spaced apart in parallel by specified distances along the line L—L. In this arrangement, the middle of the length of each rolling member 7 coincides with the travel line L—L. The radii of curvatures of the curved rolling surfaces 12*a* and 12*a* of the rolling members 7 are reduced from member to member toward the direction of travel of the film strip, while the distance between each pair of the rolling surfaces 12*a* and 12*b* is likewise progressively reduced.

The bundling means 9 is positioned on the travel line L—L to the rear of the terminal rolling member 7. In the illustrated embodiment it comprises a pair of upper and lower grooved pulleys 13 and 14. Alternatively it may be an annular member. The heat-setting means 10 provided on the travel line L—L to the rear of the bundling means 9 comprises a pair of upper and lower gears 15 and 16 meshing with each other and rotatable in the direction of advance of the film strip. Although not shown, the gears 15 and 16 are provided with a heater or like heating means. Alternatively, the heat-setting means 10 may comprise an annular metal member or trowel having a heat panel in which a heater is embedded. Since only the rolled portions to be described later need be thermally adhered together at one side of the rolled strip opposite to the other side thereof where the rolled portions are connected together by the midportion of the original film strip (see FIG. 4), the gear 16 along may be provided with the heating means in the case where the gears 15 and 16 are used, so as to fuse the first-mentioned side of the rolled portions which side is positioned as the upper side in FIG. 1. When the heat-setting means 10 comprises the pair of gears 15 and 16 as illustrated, the untwisted string 17 will be heat-set continuously when passing between the gears 15 and 16 meshing with each other, so that the string obtained has the advantage of exhibiting an increased fastening force when used. However since the string tends to pass between the meshing gears 15 and 16 in undulating fashion, thereby being heat-set throughout its interior, it is advantageous that the teeth of at least one of the gears 15 and 16 be partially cut out in circumferential direction.

Figure 4:
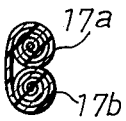
FIG. 4 is an enlarged view in section showing the film strip as completely rolled up.

When the stretched film strip 2*b* reaches the first rolling member 7, the opposite side edges 2*c* and 2*d* of the strip 2*b* pass along the curved rolling surfaces 12*a* and 12*b*, which in turn roll the edges inward. Since the curved rolling surfaces 12*a* and 12*b* of the rolling members 7 which are arranged side by side along the direction of travel of the film strip are progressively reduced in radius of curvature toward the direction of advance of the film strip, with the distance between the opposing curved rolling surfaces 12*a* and 12*b* also progressively reduced, the opposite edges 2*c* and 2*d* of the film strip are preliminarily restrained by the rolling surfaces 12*a* and 12*b* and progressively rolled inward while being deformed into a curved shape. Consequently, as the film strip advances, the opposite side edges 2*c* and 2*d* are gradually rolled in deeply as shown in FIG. 3. Thus the opposite edges of the film strip are turned in opposite directions to each other and are shaped into two rolled portions 17*a* and 17*b*. If the opposite rolling surfaces 12*a* and 12*b* of each rolling member 7 have the same radius of curvature, the two rolled portions 17*a* and 17*b* formed upon passing over the terminal rolling member 7 will have the same diameter and will be in intimate contact with each other as illustrated in FIG. 4. The rolled strip is thereafter shaped into a string by the bundling means 9. Subsequently, the heat-setting means 10 fuses the rolled strip at least in the vicinity of the contact portion between the rolled portions 17*a* and 17*b*. The string thus obtained is thereafter wound around the takeup means 11 continuously while retaining its shape and being prevented from loosening. If the opposite curved surfaces 12*a* and 12*b* in each rolling member 7 are different in radius of curvature, the two rolled portions 17*a* and 17*b* of the string 17 will differ from each other in the number of turns and therefore in diameter.

Figure 5:
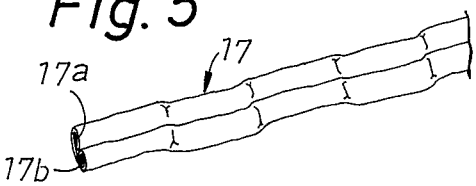
FIG. 5 is a perspective view showing an untwisted string.

In brief, the product obtained by the foregoing apparatus has two rolled portions 17*a* and 17*b* formed by being turned in different directions from each other, coextensive in parallel to each other and adhered together rectilinearly longitudinally thereof. Each rolled portion is spiral in any cross section. FIG. 5 shows the untwisted string 17 including two rolled portions 17*a* and 17*b* having the same diameter.

Figure 6:
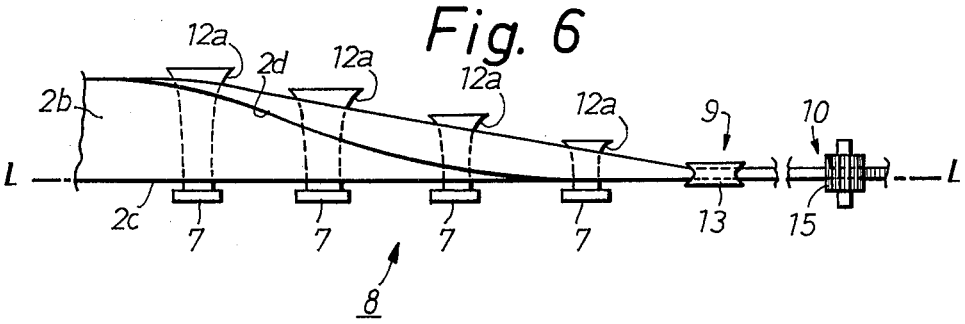
FIG. 6 is a plan view showing the principal part of another embodiment of the apparatus of this invention.
Figure 7:
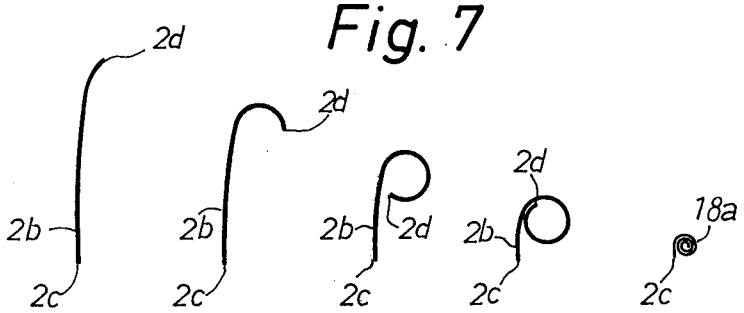
FIG. 7 is a view illustrating the steps of rolling a film strip by the embodiment of FIG. 6.
Figure 8:
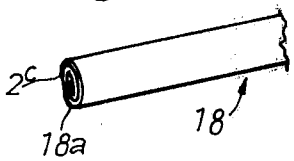
FIG. 8 is a perspective view showing an untwisted string obtained by the apparatus of FIG. 6.

FIGS. 6 and 7 show another embodiment of this invention for producing an untwisted string 18 shown in FIG. 8. The rolling members 7 shown in these figures are each formed with a curved rolling surface 12*a* only at one end of the member. The radius of curvature of the rolling surface is reduced progressively from member to member toward the direction of travel of film strip. The rolling members 7 are arranged side by side as spaced apart by specified distances such that the rolling surfaces 12*a* are positioned close to the aforesaid centerline L—L of travel toward the direction of travel of the film strip. Bundling means 9 and heat-setting means 10 are provided in the same arrangement as in the previous embodiment.

According to this embodiment, one side edge 2*d* alone of stretched film strip 2*b* is restrained by the curved rolling surface 12*a* at one end of each rolling member 7. Since the curved surfaces 12*a* are progressively reduced in radius of curvature and are positioned closer to the travel line L—L toward the direction of travel of film strip, the side edge 2*d* is rolled around itself deeply inward while being preliminarily deformed into a curved shape as shown in FIG. 7. Consequently when the rolled strip has passed over the terminal rolling member 7, it has a cross section shown in FIG. 8. Subsequently, the rolled strip is passed through the bundling means 9 and is thereby shaped into a string. It is preferable that only the free edge 2*c* be fused to the outer layer of the rolled portion 18*a* by the heat-setting means 10 so as to prevent loosening of the rolled strip. The string thus formed is finally wound around the takeup means 11.

The untwisted strings 17 and 18 obtained by the two apparatus described can be flat-shaped if the bundling means 9 provides a slit-like passage for the rolled strip. With the strings of either type, the circumferential portion thereof alone is partially fused longitudinally of the string, with the interior of the rolled portion left intact in loose state. The previously described characteristics of untwisted rolled string will not be impaired therefore. Because the untwisted string obtained by the embodiment of FIGS. 2 and 3 has two rolled portions which are adhered together, the string retains flexibility and is excellent in tensile strength, shock-absorbing properties and elasticity.

Figure 9:
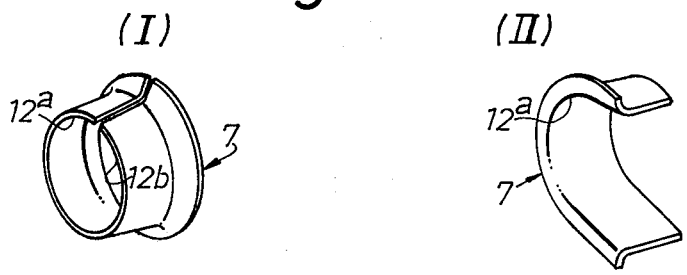
FIGS. 9 (I) and (II) are perspective views showing other examples of rolling members to be used in the embodiments of FIGS. 2 and 6 respectively.

Although the rolling member 7 are preferably rotated in the direction of advance of film strip with either type of apparatus, they need not necessarily be rotatable. Since the rolling members 7 are spaced apart by specified distances along the direction of advance of film strip, the film strip is left out of contact with the rolling members when travelling between adjacent members, with the result that it can be cooled. This renders the rolling means more advantageous than a length of such member extending continuously in the direction of advance of film strip. Each of the rolling members 7 of the apparatus of FIG. 6 is advantageously provided at the other end with a flange to prevent the widthwise displacement of the film strip during travel. Furthermore the rolling member 7 in FIGS. 2 and 6 may alternatively have a trough-like form as seen in FIGS. 9 (I) and (II). This type of rolling member functions in the same manner as those of the roll type.

Although the rolling members 7 used in the apparatus of FIG. 2 are in the form of a pulley-like roll having circumferentially continuous curved surfaces 12*a* and 12*b* at its opposite ends and a cylindrical main portion between the curved surfaces, also employable are roll-like rolling members respectively formed with circumferential grooves which are different in radius of curvature to serve as the curved rolling surfaces. Alternatively a plate-like members may be formed with grooves which are semicircular in section and different in radius of curvature so that the semicircular grooves may serve as the rolling curved surfaces.

It will be apparent to one skilled in the art that various alterations and modifications can be made to the preferred embodiments described above. For example, small grooves may be formed, as spaced apart widthwise, in the die of extruder of the T-die type to form longitudinal projections on the opposite surfaces or one surface of the film extruded for use as the material of the string. The film to be used as a material may be stretched biaxially using another stretching means of the tenter type for stretching the film widthwise.

What is claimed is:

1. An untwisted synthetic resin string, consisting essentially of a longitudinally stretched polyolefin resin film including two rolled portions, each spiral in cross section, formed by rolling the opposite side edges of the film toward each other, the rolled portions being parallel to each other in the longitudinal direction, wherein said rolled portions contact each other and only the outermost peripheral layers of the rolled portions which are in contact are thermally fused together, and the interior spirally rolled layers of each rolled portion are in loose contact with adjacent layers.

2. An untwisted synthetic resin string as set forth in claim 1 wherein said polyolefin resin film is polyethylene.

3. An untwisted synthetic resin string as set forth in claim 1 wherein said polyolefin resin film is polypropylene.

* * * * *